US006186072B1

(12) United States Patent
Hickerson, Jr. et al.

(10) Patent No.: US 6,186,072 B1
(45) Date of Patent: Feb. 13, 2001

(54) MONOLITHIC BALLASTED PENETRATOR

(75) Inventors: James P. Hickerson, Jr., Cedar Crest; Frank J. Zanner, Sandia Park; Michael D. Baldwin, Albuquerque, all of NM (US); Michael C. Maguire, Worcester, MA (US)

(73) Assignee: Sandia Corporation, Albuquerque, NM (US)

( * ) Notice: Under 35 U.S.C. 154(b), the term of this patent shall be extended for 0 days.

(21) Appl. No.: 09/255,030

(22) Filed: Feb. 22, 1999

(51) Int. Cl.[7] ..... F42B 30/00; F42B 30/08

(52) U.S. Cl. ..... 102/518; 102/518; 102/517; 102/519

(58) Field of Search ..... 102/517, 518, 102/519

(56) References Cited

U.S. PATENT DOCUMENTS

| | | |
|---|---|---|
| 3,795,196 | 3/1974 | Hillenbrand . |
| 3,935,817 | 2/1976 | Riparbelli . |
| 3,948,184 | 4/1976 | Pierre et al. . |
| 4,015,528 | 4/1977 | Barr . |
| 4,085,678 | 4/1978 | Heincker . |
| 4,108,073 | 8/1978 | Davis . |
| 4,123,975 | 11/1978 | Mohaupt . |
| 4,256,039 | 3/1981 | Gilman . |
| 4,301,737 | 11/1981 | Yuhash et al. . |
| 4,444,118 | 4/1984 | Hoffmann et al. . |
| 4,469,027 | 9/1984 | Burns et al. . |
| 4,517,898 | 5/1985 | Davis et al. . |
| 4,616,569 | 10/1986 | Montier et al. . |
| 4,619,203 | 10/1986 | Habbe . |
| 4,643,099 | 2/1987 | Luther et al. . |
| 4,648,324 | 3/1987 | McDermott . |
| 4,671,180 | 6/1987 | Wallow et al. . |
| 4,671,181 | 6/1987 | Romer et al. . |
| 4,703,696 | 11/1987 | Böcker . |
| 4,753,172 | 6/1988 | Katzmann et al. . |
| 4,793,037 | 12/1988 | Carter . |
| 4,841,867 | 6/1989 | Garrett . |
| 4,878,434 | 11/1989 | Sommet . |
| 4,879,953 | 11/1989 | Carter . |
| 5,009,166 | 4/1991 | Bilsbury et al. . |
| 5,063,855 | 11/1991 | Diel et al. . |
| 5,069,138 | 12/1991 | Ekbom . |
| 5,069,139 | 12/1991 | Denis . |
| 5,069,869 | 12/1991 | Nicolas et al. . |
| 5,087,415 | 2/1992 | Hemphill et al. . |
| 5,097,766 * | 3/1992 | Campoli et al. ..... 102/364 |
| 5,127,332 | 7/1992 | Corzine et al. . |
| 5,160,805 | 11/1992 | Winter . |
| 5,162,607 | 11/1992 | Steiner . |
| 5,291,833 | 3/1994 | Boual . |
| 5,299,501 | 4/1994 | Anderson . |
| 5,333,552 | 8/1994 | Corzine et al. . |
| 5,394,597 | 3/1995 | White . |

(List continued on next page.)

*Primary Examiner*—Charles T. Jordan
*Assistant Examiner*—Lulit Semunegus
(74) *Attorney, Agent, or Firm*—Robert D. Watson

(57) ABSTRACT

The present invention is a monolithic ballasted penetrator capable of delivering a working payload to a hardened target, such as reinforced concrete. The invention includes a ballast made from a dense heavy material insert and a monolithic case extending along an axis and consisting of a high-strength steel alloy. The case includes a nose end containing a hollow portion in which the ballast is nearly completely surrounded so that no movement of the ballast relative to the case is possible during impact with a hard target. The case is cast around the ballast, joining the two parts together. The ballast may contain concentric grooves or protrusions that improve joint strength between the case and ballast. The case further includes a second hollow portion; between the ballast and base, which has a payload fastened within this portion. The penetrator can be used to carry instrumentation to measure the geologic character of the earth, or properties of arctic ice, as they pass through it.

29 Claims, 9 Drawing Sheets

U.S. PATENT DOCUMENTS

| | | | | |
|---|---|---|---|---|
| 5,404,815 | | 4/1995 | Reed . | |
| 5,445,079 | | 8/1995 | Boual . | |
| 5,515,786 | | 5/1996 | Schilling et al. . | |
| 5,621,186 | | 4/1997 | Carter . | |
| 5,649,488 | | 7/1997 | Morrison et al. . | |
| 5,698,814 | | 12/1997 | Parsons et al. . | |
| 5,794,320 | | 8/1998 | Wernz et al. . | |
| 6,085,661 | * | 7/2000 | Halverson et al. | 102/516 |

* cited by examiner

MONOLITHIC BALLASTED PENETRATOR

The United States Government has rights in this invention pursuant to Department of Energy Contract No. DE-AC04-94AL85000 with Sandia Corporation.

CROSS REFERENCE TO RELATED APPLICATIONS (not applicable)

BACKGROUND OF THE INVENTION

This invention relates generally to the field of munitions and ordnance, and more specifically to high velocity, kinetic energy projectiles that can penetrate deeply into the earth or hardened targets.

Large, high velocity kinetic energy penetrators are used as munitions, weapons, and vehicles to carry instrumentation or other apparatus. As such, they are typically delivered by aircraft, missiles, or cannon into the ground, a body of water, or a man-made structure, hereafter referred to as the target. These types of penetrators usually carry a payload of instrumentation or high explosive and must survive the violent actions that accompany impact and sudden deceleration, all the while protecting and preserving the payload. Examples are penetrators built to attack buried military targets surrounded by thick concrete ceilings and walls, or penetrators built to carry instrumentation to measure the geologic character of the earth or properties of arctic ice as they pass through it.

A penetrator can be subjected to both high positive and negative longitudinal acceleration forces, as well as rotational acceleration forces, during its brief flight. The device may be subjected to a positive acceleration on the order of 5000 g during launch by a missile or gun, and it may be subjected to a negative acceleration on the order of 20,000 g upon impact with a hardened target. Because of these loads, it is preferable that the case be a monolithic construction, i.e., formed from a single piece of hard material such as a high-strength steel alloy. The use of monolithic construction eliminates failures of joints and fasteners that are possible in multi-part cases. An example of a monolithic penetrator currently in use as an anti-tank weapon is the class of sub-caliber solid tungsten "spears" or "darts" that are conveyed by a sabot during gun launching.

Prior art penetrators have been used successfully at low velocities against hard targets such as competent rock and concrete, or at high velocities against soft targets such as soil. Designing penetrators that can penetrate deeply and survive the impact with hard targets at velocities in excess of 2000 feet per second (ft/s) has been found to be particularly difficult, especially for sizes larger than the small prototypes used in indoor laboratory testing. The present invention can impact the media and survive at velocities up to and exceeding 4000 ft/s. High velocity impacts with hard targets can cause severe nose abrasion, bending, and frequent breakage. Penetration depth is reduced in hard targets. Also, the high deceleration forces that accompany impact can damage the payload.

Penetration of hard targets is achieved by concentrating a high amount of kinetic energy (KE) on a small area to create a very high stress. Use of heavy metal penetrators, such as tungsten (which has a density about twice that of steel) allows the KE to be doubled while keeping the outer dimensions of the penetrator constant, thereby penetrating the target to a much greater depth. These penetrators are typically pointed bodies fabricated in the shape of a "spear" or a "dart", often with guiding fins, from sintered tungsten or liquid-phase sintered W—Ni—Fe alloys. These "dart" type penetrators are typically sub-caliber and require the use of a sabot holder during gun launch.

It is well known to those skilled in the art that if a means were found to increase the total mass while keeping the outer dimensions of the penetrator constant, then the shocks and decelerations of impact would be lessened and the penetrator would travel deeper into the target. Unfortunately, tungsten is brittle and fails prematurely when used to construct the penetrator. Lead, another dense, heavy metal, is much too soft and weak to be used for this application. The best use for heavy materials is as a ballast, while using high-strength steel for the penetrator's nose and case.

When a heavy material is used internally as ballast it is usually difficult to secure and hold in place during violent impacts without making use of large mechanical fixtures, which take up space desired for the payload. Because it is simply carried as a high-density mass, prior art ballasts typically contribute no strength to the penetrator's case. Rather, the ballast adds to the loads and forces that the penetrator's case must support in order to survive.

Prior art penetrators are typically made from steel or tungsten ingot or bar stock by a combination of forging and machining operations. Forging is used to reduce the ingot to nearly the proper diameter and sometimes to create a cavity in the interior that will become the payload bay. Machining then creates the final shape. If the penetrator is made of steel, then it must be heat-treated to achieve a hardness and strength necessary for survival during penetration of the hard target. At some point the ballast, if required, must be installed. Pure mechanical attachment by machined threads or bolts is difficult and expensive. High temperature joining methods, such as brazing or diffusion bonding, destroy the prior heat treatment of the steel case and reduce its hardness and strength. Finally, it is desirable to minimize the cost of a penetrator by reducing the number of fabrication steps and the time necessary for expensive machining operations.

Another class of prior art penetrators utilize shaped explosive charges to create a hyper-velocity jet of molten metal which is very effective at penetrating thick (multi-inch) metal armor (such as tank armor). However, these devices do not perform well against massively thick concrete bunkers (~10 feet thick), and typically are more expensive and complex to manufacture than simple heavy metal penetrators.

Another class of prior art penetrators utilizes a single, heavy metal "dart", or blunt or pointed rod that is contained inside of a hollow steel case. The heavy rod is released from the case upon impact and travels alone through the target. Often, the nose of the projectile is made of a hollow, thin-walled ballistic shroud. The present invention differs from this design in that the present heavy material ballast remains completely contained inside of, and travels with, the steel case during penetration.

Most prior art penetrators do not carry a payload.

BACKGROUND ART

Many U.S. Patents have been granted that describe penetrating projectiles and methods for manufacturing them. However, none of the following references completely describe the present invention.

A. Wernz and W Katzmaier, U.S. Pat. No. 5,794,320 (1998) describe a method for manufacturing a core bullet comprising the steps of: (1) machining the core shank and nose-end, (2) formfitting (swaging) a jacket blank to the core shank, and (3) final machining. Wernz and Katzmaier's method uses swaging to lock the jacket around the solid core. Their method leaves a hole in the jacket at the tip of the nose end. This "hollow-point" design will result in radial expansion of the jacket into "petals" as the projectile travels through the target. Such "flowering" of the case upon impact severely limits the depth of penetration into hardened targets.

G. Parsons et al., U.S. Pat. No. 5,698,814 (1997) describe a penetrator comprising a long, hollow, monolithic cylindrical outer shell constructed of high strength steel and having a pointed nose. The cylinder contains an insensitive explosive that is separated into multiple segments by shock-attenuating materials so that one segment may detonate without destroying adjacent segments. The penetrating capability of this projectile is not as great as the present invention because Parson's design does not include a dense, heavy material insert of any type, which results in lower kinetic energy for the same diameter of the outer case.

A. Morrison, et al., U.S. Pat. No. 5,649,488 (1997) describes a non-explosive target directed reentry projectile comprising a hollow casing of heat shielding material, a kinetic energy core enclosed within the hollow casing, and an empty space between said casing and said core. Morrison's projectile will not penetrate deeply into hardened targets because: it does not have a monolithic case, the heavy metal core is not in contact with the case, and it does not carry any payload. Also, it is not designed to be gun launched at high velocity.

H. Carter, U.S. Pat. No. 5,621,186 (1997) describes a bullet comprising an outer jacket of copper alloy and an inner core made of lead. Carter's invention includes a hole in the tip of the nose end to encourage radial expansion of the jacket into multiple, flowered "petals" as the projectile travels through the target. Such "flowering" of the case upon impact severely limits the depth of penetration into hardened targets.

M. Schilling, et al., U.S. Pat. No. 5,515,786 (1996) describes a projectile for attacking hard targets, which includes the use of a shaped explosive charge. This projectile uses shaped explosive charges to burn through thick steel plates. However, penetrators using shaped charges can not penetrate deeply (e.g. greater than 10 feet) in hardened concrete targets because their total kinetic energy is too low, for the same outer diameter.

R. Boual, U.S. Pat. No. 5,445,079 (1995) describes an armor-piercing fragmentation projectile comprising a copper ballistic shroud, a steel case, a steel penetrator, and a heavy metal ballast located behind the steel penetrator. Since Boual's projectile uses an outer case made up of two, joined interlocking pieces, his projectile will not penetrate as deeply as a penetrator made with a (stronger) one-piece, monolithic case. Also, Boual's projectile can not carry a payload.

L. Reed, U.S. Pat. No. 5,404,815 (1995) describes a design and method for fabricating a bullet, comprising the steps of: (1) advancing a swaging tool into the jacket to compress the jacket walls, (2) inserting a weighted material into the jacket, and (3) bending the jacket to form the shouldered lip. This invention, and method for making the bullet, describes an outer case with a hole at its tip. This "hollow-point" design results in radial expansion of the case into "petals" as the projectile travels through the target. Such "flowering" of the case upon impact severely limits the depth of penetration into hardened targets. Also, this invention, and method for making the bullet, does not have the ability to either explosively damage the target after penetration, or take data from an instrumentation package during (or after) penetration because the invention, and method for making the bullet, does not include any type of payload.

J. White, U.S. Pat. No. 5,394,597 (1995) describes a method for making high velocity projectiles comprising the steps of: (1) forming a thin metal sheet into a cylindrical configuration; (2) inserting the formed metal cylinder into a metal jacket, and (3) compressing the formed metal cylinder in the metal jacket. This method for making the projectile produces an outer case with a hole at its tip. This "hollow-point" design results in radial expansion of the case into "petals" as the projectile travels through the target. Such "flowering" of the case upon impact severely limits the depth of penetration into hardened targets. Also, this method does not produce a projectile having the ability to either explosively damage the target after penetration, or take data from an instrumentation package during (or after) penetration because the method for making the projectile does not include any type of payload. This method results in a projectile design that can not achieve deep penetration into hardened targets because the dense core is made of soft lead, rather than a high strength W—Ni—Fe alloy.

A. Corzine and G. Eberhart, U.S. Pat. No. 5,333,552 (1994) describe a hunting bullet with a reinforced core comprising a unitary metal body having an ogival nose portion with an empty hollow point, and a dense core filling a cavity within said body, the dense core being of higher density and lower tensile strength than said body. Corzine and Eberhart's invention has a hole in the tip of its nose end to encourage radial expansion of the jacket into "petals" as the projectile travels through the target. Such "flowering" of the case upon impact severely limits the depth of penetration into hardened targets.

R. Anderson, U.S. Pat. No. 5,299,501 (1994) describes a frangible armor piercing incendiary projectile comprising a hard heavy metal penetrator rod core surrounded by a two-part outer case. Since Anderson's projectile uses an outer case made up of two, joined interlocking pieces, his projectile will not penetrate as deeply as a penetrator made with a (stronger) one-piece, monolithic case.

R. Boual, U.S. Pat. No. 5,291,833 (1994) describes an armor-piercing fragmentation subcaliber projectile having a body made of a dense material, a head adjacent a front part of the body, and a transmission element for transmitting axial thrust interposed between the body and the head, for causing multiple fragmentation by exerting a radial force on the body. Upon contact of the projectile with the target, the body moves forward relative to the conical core transmission element, thereby producing large radial forces on the body that fractures and fragments it. This projectile will not penetrate as deeply as the present invention because the multi-part jointed case is not as strong as a single-piece, monolithic case. Likewise, the radial forces on the body fracture it upon impact, reducing the ability to deeply penetrate because the case has disintegrated. Also, since the hard core is loose and not bonded to the case, then the core can not provide additional structural support to the case, as in the present invention. Also, the projectile does not have the ability to either explosively damage the target after penetration, or take data from an instrumentation package during (or after) penetration because the invention does not include any type of payload.

E. Steiner, U.S. Pat. No. 5,162,607 (1992) describes a long rod, sub-caliber kinetic energy penetrator comprising a one piece elongated solid hard metal body having a plurality of axially spaced circumferential reinforcing bands mechanically interlocked with said body. The reinforcing bands stiffen the penetrator during impact with a target at oblique angles. This projectile will not penetrate as deeply as the present invention because the nose end is made of a brittle heavy metal alloy, rather than high-strength steel, as in the present invention. In addition, the projectile does not have the ability to either explosively damage the target after penetration, or take data from an instrumentation package during (or after) penetration because the invention does not include any type of payload. Also, this projectile requires the use of a discarding sabot carrier, which is an extra piece of equipment that is not required by the present invention.

U. Winter, U.S. Pat. No. 5,160,805 (1992) describes a projectile for a hand-held firearm comprising a dense core surrounded by a metal jacket which has a large hole in the nose end through which the core projects. Winter's invention describes an outer jacket (e.g. case) that has a hole in the tip of the nose end to encourage radial expansion of the jacket into "petals" as the projectile impacts the target. Such "flowering" of the case upon impact severely limits the depth of penetration into hardened targets.

A. Corzine and G. Eberhart, U.S. Pat. No. 5,127,332 (1992) describe a hunting bullet with reduced environmental lead exposure comprising a unitary metal body with an empty hollow point in the tip of the nose, and a dense metal core. Corzine and Eberhart's invention describes an outer jacket that has a hole in the tip of the nose end to encourage radial expansion of the jacket into "petal" as the projectile travels through the target. Such "flowering" of the case upon impact severely limits the depth of penetration into hardened targets.

R. Hemphill and D. Wert, U.S. Pat. No. 5,087,415 (1992) describe a high strength, high fracture toughness structural steel alloy that is age-hardenable. No penetrators, or munitions of any type, are described in their patent.

J. Nicolas and R. Saulnier, U.S. Pat. No. 5,069,869 (1991) describe a method for direct shaping of penetrating projectiles of high-density tungsten alloy comprising the steps of: (1) preparing a mass of W, Ni, Fe and Cu powders, (2) compacting the powders into a rough shaped blank, (3) sintering the blank to reach 17 g/cm$^3$, and (4) work-hardening the blank by a rotary hammering operation. This method results in a projectile design that can not achieve deep penetration into hardened targets because it produces a penetrator consisting only of a brittle heavy-metal alloy, rather than a high-strength steel monolithic case that substantially surrounds a heavy-material ballast, as in the present invention.

J. Denis, U.S. Pat. No. 5,069,139 (1991) describes a projectile intended to be fired by a fire-arm comprising a hard metal penetrator core, a soft heavy metal (e.g. lead) inertia block behind said core, and a ductile metal jacket over both the core and heavy metal inertia block. The performance of Denis' invention is limited by that fact that it does not carry any type of payload. Also, deep penetration may not be achieved because the lead inertia block is a much weaker material compared to the family of tungsten alloys. Finally, flight instabilities may occur since the lead inertia block in Denis' invention is located towards the rear of the projectile, rather than towards the front.

L. Ekbom, U.S. Pat. No. 5,069,138 (1991) describes an armor-piercing projectile with a spiculating core comprising an elongated arrow style projectile with a core surrounded by a body, where the hardness of the core is greater than twice the hardness of the body. In Ekbom's invention the outer case is made out of a heavy metal alloy, such as tungsten or uranium alloy. The brittle behavior of these alloys will prevent this projectile from achieving deep penetration in hardened targets, when compared to cases made of high-strength and high-toughness steel alloys. Also, the performance of Ekbom's invention is limited by that fact that it does not carry any type of payload.

R. Diel, et al., U.S. Pat. No. 5,063,855 (1991) describes a spear-like projectile arrangement comprising a sub-caliber heavy metal spear-like core surrounded by a segmented, discardable sabot that separates from the core after exiting the gun's nozzle. This projectile will not penetrate as deeply as the present invention because the nose end is made of a brittle heavy metal alloy, rather than high-strength steel, as in the present invention. In addition, the projectile does not have the ability to either explosively damage the target after penetration, or take data from an instrumentation package during (or after) penetration because the invention does not include any type of payload. Also, this projectile requires the use of a discarding sabot carrier, which is an extra piece of equipment that is not required by the present invention.

S. Bilsbury, et al., U.S. Pat. No. 5,009,166 (1991) describes a low cost penetrator projectile comprising a hard metal penetrator core, a soft heavy metal slug (e.g. lead) body behind said core, and a metal jacket over both the core and heavy metal slug. The performance of Bilsbury's invention is limited by that fact that it does not carry any type of payload. Also, deep penetration may not be achieved because the lead slug is a much weaker material compared to the family of tungsten alloys, and because the high-strength penetrating core only partially surrounds the lead slug. Finally, flight instabilities may occur since the lead slug is not located towards the front of the projectile.

H. Carter, U.S. Pat. No. 4,879,953 (1989) describes a bullet comprising an outer jacket of copper alloy and an inner core made of lead. Carter's invention describes an outer jacket that has a hole in the tip of the nose end to encourage radial expansion of the jacket into "petals" as the projectile travels through the target. Such "flowering" of the case upon impact severely limits the depth of penetration into hardened targets.

P. Sommet, U.S. Pat. No. 4,878,434 (1989) describes a penetrating projectile with a hard core and ductile guide comprising a pointed core made of a hard or high density metal surrounded by a ductile metal guide around the rear portion of the core, with a caliber less than 40 mm. Sommet's projectile will not penetrate as deeply as the present invention because it contains no dense ballast. It also does not carry any type of payload.

H. Garrett, U.S. Pat. No. 4,841,867 (1987) describes a sub-caliber projectile comprising a solid metal core, a ballistic shroud piece, the core being surrounded by a discarding sabot that separates from the core after exiting the gun's nozzle. This projectile will not penetrate as deeply as the present invention because the multi-part jointed case is not as strong as a single-piece, monolithic case. Also, since the hard core is loose and not bonded to the case, then the core can not provide additional structural support to the case, as in the present invention. In addition, the projectile does not have the ability to either explosively damage the target after penetration, or take data from an instrumentation package during (or after) penetration because the invention does not include any type of payload.

H. Carter, U.S. Pat. No. 4,793,037 (1988) describes a method of making a bullet comprising the steps of: (1) machining the outer jacket from a rod of copper-based material, (2) placing lead in the jacket, (3) melting the lead to promote bonding, and to anneal the jacket, (4) drawing the outside diameter of the jacket, and (5) forming the cylindrical portion into the desired ogive design while increasing the diameter of the base portion. This method for making the bullet produces an outer case with a hole at its tip. This "hollow-point" design results in radial expansion of the case into "petals" as the projectile travels through the target. Such "flowering" of the case upon impact severely limits the depth of penetration into hardened targets. Also, this method does not produce a projectile having the ability to either explosively damage the target after penetration, or take data from an instrumentation package during (or after) penetration because the method for making the projectile does not include any type of payload. This method results in a projectile design that can not achieve deep penetration into hardened targets because the dense core is made of soft lead, rather than a high strength W—Ni—Fi alloy.

H. Katzmann, et al., U.S. Pat. No. 4,753,172 (1988) describe a kinetic energy sabot projectile comprising a metal jacket and tip that contain an inert powdered filler material with a density greater than 10 g/cm$^3$. This projectile design can not achieve deep penetration into hardened targets because the dense core is made of a soft, powdered filler material, rather than a high strength W—Ni—Fe alloy. The powdered filler core does not provide additional structural support to the case, as in the present invention. Also, the projectile does not have the ability to either explosively damage the target after penetration, or take data from an instrumentation package during (or after) penetration because the invention does not include any type of payload.

J. Bocker, U.S. Pat. No. 4,703,696 (1987) describes a penetrator for a subcaliber impact projectile comprising a metal casing, a core of substantially higher density than the casing, said core being subdivided longitudinally into a multiplicity of elongate core parts, a boundary layer material interposed between said parts for impeding crack propagation within the core parts, and a ballistic shroud. In Bocker's invention the dense core parts are not bonded to the outer metal case because they are separated from the case by the boundary layer material. This projectile will not penetrate as deeply as the present invention because the multi-part jointed case is not as strong as a single-piece, monolithic case. Also, since the hard core parts are loose and not bonded to the case, then the core can not provide additional structural support to the case, as in the present invention. In addition, the projectile does not have the ability to either explosively damage the target after penetration, or take data from an instrumentation package during (or after) penetration because the invention does not include any type of payload. Also, this projectle requires the use of a discarding sabot carrier, which is an extra piece of equipment that is not required by the present invention.

R. Romer, et al., U.S. Pat. No. 4,671,181 (1987) describe an anti-tank shell comprising a dense, heavy metal core partially surrounded by a steel case. This invention describes an outer case that does not surround the tip of the nose end. This "hollow-point" design results in radial expansion of the case into "petals" as the projectile travels through the target. Such "flowering" of the case upon impact severely limits the depth of penetration into hardened targets. This projectile will not penetrate as deeply as the present invention because the multi-part jointed case is not as strong as a single-piece, monolithic case. Also, this projectile requires the use of a discarding sabot carrier, which is an extra piece of equipment that is not required by the present invention.

Wallow and B. Bisping, U.S. Pat. No. 4,671,180 (1987) describe an armor-piercing inertial projectile comprised of three metallic bodies coaxially mounted one behind the other, surrounding a plurality of armor-piercing partial cores. This projectile will not penetrate as deeply as the present invention because the multi-part jointed case is not as strong as a single-piece, monolithic case. Also, since the hard core is loose and not bonded to the case, then the core can not provide additional structural support to the case, as in the present invention. Also, the projectile does not have the ability to either explosively damage the target after penetration, or take data from an instrumentation package during (or after) penetration because the invention does not include any type of payload.

B. McDermott, U.S. Pat. No. 4,648,324 (1987) describes projectile comprising an elongated thick walled, multi-part case having a main body with a cavity and a nose with a bore that extends into the cavity. A heavy penetrating rod extends through the cavity into the bore, through which it is propelled by explosives in the cavity when the nose is detonated at impact. This projectile will not penetrate as deeply as the present invention because the multi-part jointed case is not as strong as a single-piece, monolithic case. Also, since the hard core is loose and not bonded to the case, then the core can not provide additional structural support to the case, as in the present invention.

H. Luther, U.S. Pat. No. 4,643,099 (1987) describes an armored-piercing projectile comprising a heavy metal core, a hollow ballistic shroud, and a segmented sabot that separates from the core after exiting the gun's nozzle. This projectile will not penetrate as deeply as the present invention because the nose end is made of a brittle heavy metal alloy, rather than high-strength steel, as in the present invention. In addition, the projectile does not have the ability to either explosively damage the target after penetration, or take data from an instrumentation package during (or after) penetration because the invention does not include any type of payload. Also, this projectile requires the use of a discarding sabot carrier, which is an extra piece of equipment that is not required by the present invention.

R. Habbe, U.S. Pat. No. 4,619,203 (1986) describes an armor piercing small caliber projectile comprising a jacket, a case-hardened steel nose portion, and a lead core portion. This projectile design can not achieve deep penetration into hardened targets because the dense core is made of soft lead, rather than a high strength W—Ni—Fe alloy. Also, the projectile does not have the ability to either explosively damage the target after penetration, or take data from an instrumentation package during (or after) penetration because the invention does not include any type of payload.

P. Montier, et al., U.S. Pat. No. 4,616,569 (1986) describes an armor penetrating projectile comprising an outer case surrounding a inner core made of a stronger and more elastic material. The inner core is formed with a plurality of axially spaced thickened regions having cylindrical outer surfaces engaging the inner bore of the case. Since the hard core is not substantially surrounded by, and bonded to, the case, then the core can not provide additional structural support to the case, as in the present invention. This will reduce the performance of Montier's design. Also, the projectile does not have the ability to either explosively damage the target after penetration, or take data from an instrumentation package during (or after) penetration because the invention does not include any type of payload.

D. Davis and J. Robbins, U.S. Pat. No. 4,517,898 (1985) describe a highly accurate projectile for use with small arms comprising a completely solid core surrounded partially by a metal jacket, wherein the center of pressure is located substantially forward of the center of gravity. The outer metal jacket does not cover the rear end of the solid core. This projectile design can not achieve deep penetration into hardened targets because the dense core is made of soft lead, rather than a high strength W—Ni—Fe alloy. Also, the projectile does not have the ability to either explosively damage the target after penetration, or take data from an instrumentation package during (or after) penetration because the invention does not include any type of payload. Additionally, the projectile will not penetrate as deeply as the present invention because Davis' design uses a flat, blunt tip, rather than a pointed tip on the nose end.

B. Burns and W Donovan, U.S. Pat. No. 4,469,027 (1984) describe an armor piercing ammunition comprising a heavy metal core and a segmented sabot with both right-handed and left-handed threads that separates from the core after exiting the gun's nozzle. This projectile will not penetrate as deeply as the present invention because the nose end is made of a brittle heavy metal alloy, rather than high-strength steel, as in the present invention. In addition, the projectile does not have the ability to either explosively damage the target after penetration, or take data from an instrumentation package during (or after) penetration because the invention does not include any type of payload. Also, this projectile requires the use of a discarding sabot carrier, which is an extra piece of equipment that is not required by the present invention.

D. Hoffmann and O. Gunther, U.S. Pat. No. 4,444,118 (1984) describe an armor-piercing projectile comprising a ballistic shroud, an outer metallic hollow shell body, and a core made of a hard or heavy metal. This projectile will not penetrate as deeply as the present invention because the multi-part jointed case is not as strong as a single-piece, monolithic case. Also, since the hard core is loose and not bonded to the case, then the core can not provide additional structural support to the case, as in the present invention.

L. Yuhash and C. Lanizzani, U.S. Pat. No. 4,301,737 (1981) describe multi-purpose kinetic energy projectile comprising a monolithic penetrator core surrounded by a plurality of flat blades disposed radially about said core, adapted to disperse radially outwardly by centrifugal force as said projectile exits from a gun. The blades act as an anti-personnel round, while the penetrator core is for piercing armor. The penetrating capability of this projectile is greatly reduced because much of the mass (and kinetic energy) is lost impact with the target because the plurality of flat blades are ejected radially, rather than travelling through the target. Also, the projectile does not have the ability to either explosively damage the target after penetration, or take data from an instrumentation package during (or after) penetration because the invention does not include any type of payload.

J. Gilman, U.S. Pat. No. 4,256,039 (1981) describes an armor-piercing projectile comprising an axial core, a continuous strip of metallic glass wound about said core, and bonding means for joining the adjacent laminated surfaces. Gilman's invention describes an outer case with a hole at its tip. This "hollow-point" design results in radial expansion of the jacket into "petals" as the projectile travels through the target. Such "flowering" of the case upon impact severely limits the depth of penetration into hardened targets. Also, Gilman's projectile does not have the ability to either explosively damage the target after penetration, or take data from an instrumentation package during (or after) penetration because their invention does not include any type of payload.

H. Mohaupt, U.S. Pat. No. 4,123,975 (1978) describes a penetrating projectile system for fracturing rock comprising a hard, dense core; a body sleeve made of a ductile material, and a nose cap made from a light weight, ductile material. This projectile will not penetrate as deeply as the present invention because the multi-part jointed case is not as strong as a single-piece, monolithic case.

D. Davis, U.S. Pat. No. 4,108,073 (1978) describes an armor piercing projectile with a long, thin penetrator core element having a tapered forward portion, surrounded by a monocoque jacket substantially surrounding said core, with a rigid inert filler material disposed between said core and said jacket for supporting said core. Davis' invention describes an outer jacket that does not cover the tip of the core. This "hollow-point" design results in radial expansion of the jacket into "petals" as the projectile travels through the target. Such "flowering" of the case upon impact severely limits the depth of penetration into hardened targets. Also, Davis' projectile does not have the ability to either explosively damage the target after penetration, or take data from an instrumentation package during (or after) penetration because the invention does not include any type of payload.

W. Heincker, U.S. Pat. No. 4,085,678 (1978) describes a penetrator having a forward penetrator section, an aft follow-through section, and a mid frangible section which breaks on impact. The forward section fractures the target and the aft section follows through with the payload. This invention is designed to break into two main parts after impact. This projectile will not penetrate as deeply as the present invention because it does not use a dense, heavy metal ballast insert to increase the total kinetic energy (for the same diameter). Also, this projectile will not penetrate as deeply as the present invention because it is designed to break into two parts after impact, rather than being constrained by a high-strength, monolithic steel case.

I. Barr, U.S. Pat. No. 4,015,528 (1977) describes a high density armor piercing projectile comprising a high density penetrator core with a tapered front end and a multi-part outer case in partial contact with the core. This projectile will not penetrate as deeply as the present invention because the multi-part jointed case is not as strong as a single-piece, monolithic case. Also, since the hard core is loose and not bonded to the case, then the core can not provide additional structural support to the case, as in the present invention. In addition, the projectile does not have the ability to either explosively damage the target after penetration, or take data from an instrumentation package during (or after) penetration because the invention does not include any type of payload.

B. Pierre and C. Sabin, U.S. Pat. No. 3,948,184 (1976) describe a sub-caliber projectile shell where the shell includes a core wedged rearwardly in a shoe and is attached by a glue joint to a destructible plastic skirt fixed to the shoe. During acceleration imparted to the shell upon firing, the glue joint ruptures and liberates the core piece from the shell. Pierre and Sabin's projectile will not penetrate as deeply into a hardened target because their core piece separates from the shell during firing, rather than staying intimately bonded. Also, Pierre and Sabin's projectile does not have the ability to either explosively damage the target after penetration, or take data from an instrumentation package during (or after) penetration because their invention does not include any type of payload.

C. Riparbelli, U.S. Pat. No. 3,935,817 (1976) describes a penetrating spear comprising an elongated solid rod made of a hard metal having a length many times its diameter, with guiding fins. This projectile will not penetrate as deeply as the present invention because the nose end is made of a brittle heavy metal alloy, rather than high-strength steel, as in the present invention. In addition, the projectile does not have the ability to either explosively damage the target after penetration, or take data from an instrumentation package during (or after) penetration because the invention does not include any type of payload. Also, this projectile requires the use of a rocket engine to accelerate it. It can not be gun launched at high velocities, as in the present invention.

H. Hillenbrand, U.S. Pat. No. 3,795,196 (1974) describes a projectile with a loose hard core and a multi-part, jointed case. Hillenbrand's invention will not penetrate as deeply as the present invention because the multi-part jointed case is not as strong as a single-piece, monolithic case. Also, since Hillenbrand's hard core is loose and not bonded to the case, then the core can not provide additional structural support to the case, as in the present invention. Also, Hillenbrand's projectile does not have the ability to either explosively damage the target after penetration, or take data from an instrumentation package during (or after) penetration because the invention does not include any type of payload.

SUMMARY OF THE INVENTION

The present invention is a monolithic ballasted penetrator that comprises a single-piece, un-jointed steel (or other high-strength metal) case surrounding a ballast whose density is substantially greater than the case. The case has an elongated, generally cylindrical shape extending along the axis of penetrating motion. The nose end of the case may be shaped as a pointed cylinder, shallow cone, or ogive shape, with the ballast ideally occupying the forward region of the interior. The nose end is pointed, with no hole, depression, or indentation at the tip. The ballast is a solid mass that is substantially surrounded by the high-strength metal case. Aft of the ballast is a hollow cavity in which an optional payload is carried. Examples of payloads include: (1) the combination of an energetic material (e.g. explosive, incendiary material) with an arming and fuzing device, or (2) an instrumentation package. The rear of the assembly is flat and may be closed by an end cap, plug, or cover plate. The assembly is fabricated by casting the outer metal case around the ballast, using appropriate molds and cores to create the shape and internal features. The cast assembly comprises a solid monolith that contains the ballast in its final form and is ready for finishing operations such as minor machining and heat treatment to harden the case.

The present invention significantly improves in a number of important ways upon prior art penetrators made either of all-steel or all-tungsten bodies. First, a dense, heavy material ballast is placed inside the nose of the penetrator's case to increase its total mass and kinetic energy, which maximizes the volume available for the payload without increasing the outer diameter of the case. Locating the ballast as far forward as possible places the center-of-mass in a forward location in order to improve the dynamic stability of the penetrator during flight and transit. Also, the forward location of the center-of-gravity causes the penetrator to rotate less during oblique angle impacts, resulting in less lateral loading in the side-walls of the case, thus allowing it to be used at higher velocities than conventional all-steel penetrators.

Secondly, the high-strength steel case is cast directly around the ballast, mechanically locking the two parts together. The use of a monolithic cast steel case provides greater strength than typical multi-part cases that are mechanically connected (e.g. with screw threads). The closely coupled heavy material ballast insert also becomes a structural load-bearing member that strengthens the case. This allows the penetrator can be gun-launched into a target at very high velocities without the ballast coming free. Also, strongly coupling the ballast to the case assures that the ballast will not move or rattle during penetration of the target (especially if the target is multi-layered or non-homogenous). Rattling of the ballast creates shocks that can damage or destroy sensitive instrumentation or fuzing electronics.

Finally, this invention uses a novel fabrication process (i.e. casting) that simultaneously joins the case and the ballast. Casting produces a monolith that needs minimal machining, allows necessary heat treatments, and eliminates or reduces costly operations such as brazing or machining. Also, casting of the structural case permits the simultaneous creation of internal and external features that are not possible, or practical, in a penetrator produced by other processes (e.g. machining). These features include internal mounting pads, rings, and stiffening ribs (internal or external) possessing reentrant angles that could not otherwise be produced by conventional machining, such as turning the penetrator on a lathe.

Another embodiment of the present invention comprises a monolithic ballasted penetrator without any payload or hollow cavity. Such a device could be employed, for example, to deeply penetrate solid rock in order to facilitate mining activities, such as deeply placing explosive charges.

In summary, the present invention, a ballasted monolithic penetrator, has the advantage of being able to survive impacts at velocities exceeding currently existing weapons, and to penetrate more deeply into the target than conventional all-steel or all-tungsten penetrators that carry the same payload.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
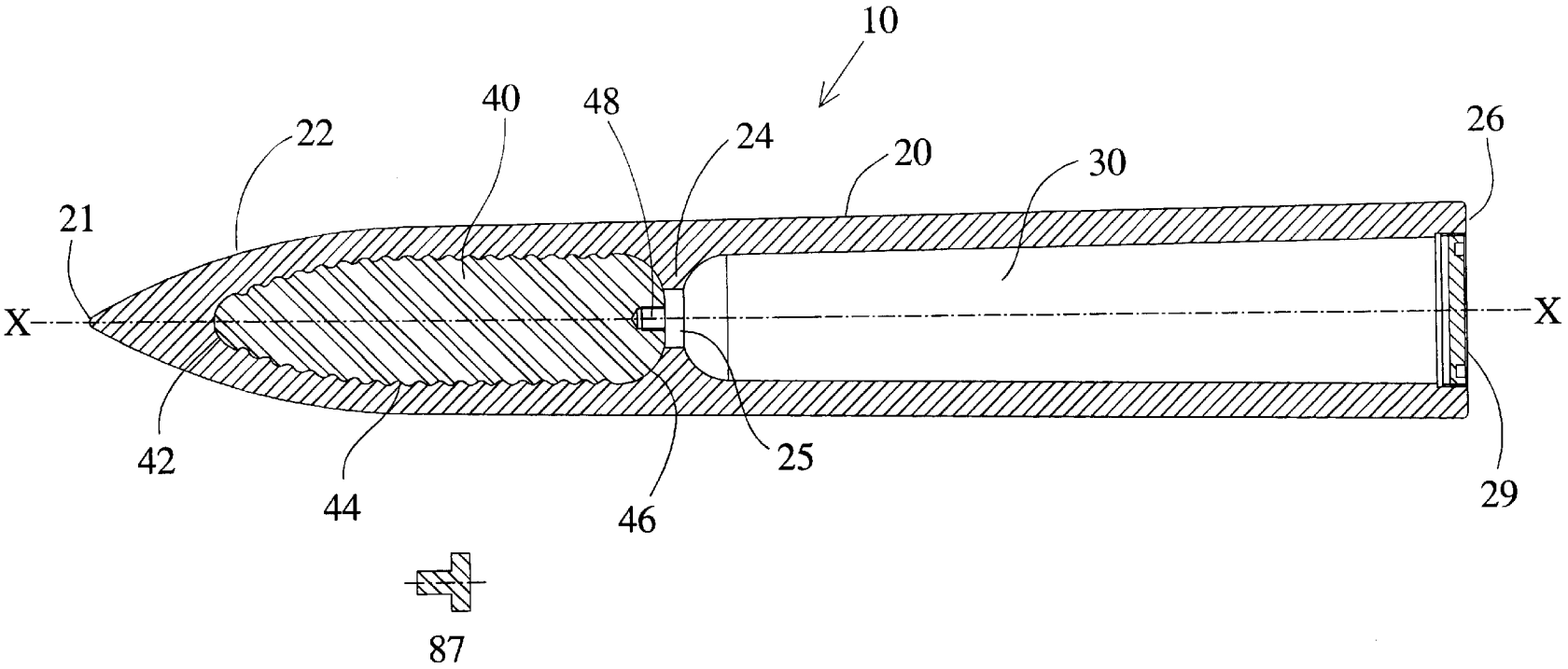
FIG. 1 shows a sectional view of a monolithic ballasted penetrator with an open cavity.

As shown in FIG. 1, a preferred embodiment of a penetrator 10 according to this invention includes a case 20 that is cast from a high-strength steel around a ballast 40 to create a permanently-joined, monolithic structure that incorporates both parts. Case 20 extends from the pointed tip 21 of a nose end 22 to a flat base 26 has a rearwardly open cavity 30. Use of a flat end 26 is preferred over some other shape, such as a truncated cone or "boat-tail" shape, because the flat end reduces the potential for tumbling during penetration. The outer surface of the middle section of case 20 has continuous and unjointed side walls.

Nose end 22 has a generally ogival shape, chosen according to principles known in the art to provide maximum penetration and minimal shocks to the payload when the penetrator 10 strikes a rigid target, such as reinforced concrete. Case 20 is preferably symmetrical about a longitudinal axis XX in order to maintain a stable trajectory during flight in air and inside of the target. Axis XX is aligned with the direction of penetrating motion. Case 20 has an elongated, generally cylindrical or conical shape extending along axis XX. The details of external size and geometry, as well as the internal configuration, may be changed to suit the particular application.

Ballast 40 is preferably a solid mass of a very dense (greater than about 13 g/cm$^3$), high-strength material, with good high temperature tensile strength and fracture toughness. Some examples, chosen from the group of refractory materials, include: tungsten, tantalum, tungsten alloys (W—Fe—Ni, W—Re, W—Hf—Re, W—$LaO_2$, W—$ThO_2$) single crystal tungsten, tungsten carbide, cemented tungsten carbide (tungsten carbide-cobalt). Depleted uranium and its alloys can also be used. Lead, commonly used in small caliber bullets, is too soft and weak for this application. Precious heavy metals such as: Au, Hf, Ir, Os, Pt, and Rh could also be used for ballast, except that they are very expensive, and some of them have too low a melting point. The ballast should also have a melting temperature that is substantially greater than the monolithic case metal, since the case metal is cast in a molten state around the solid ballast core (which effectively eliminates the use of lead as a ballast material). Use of a high-strength, tough steel alloy for the monolithic case 20 and tungsten alloys for the ballast 40 are examples of materials that satisfy all of these requirements.

The outer surface of ballast 40 extends from a front end 42, tapered to fit within the decreasing diameter of shaped nose end 22 of case 20, to a ballast rear end 46. This outer surface is preferably symmetrical about a ballast longitudinal axis. This ballast longitudinal axis is substantially coincident with axis XX. Ballast 40 has an elongated, generally cylindrical or conical shape extending along axis XX. The forward end 42 of Ballast 40 is contoured to a shape similar to the nose of the penetrator (e.g. ogival) so that it can be fitted as far forward as possible. This helps to locate the center of mass biased towards the nose of the penetrator which, in turn, contributes to a straight and stable trajectory as the penetrator proceeds through the target.

To ensure that ballast 40 cannot move relative to case 20, case 20 extends over substantially the entire outer surface of ballast 40, including a large portion of rear end 46. In the example shown in FIG. 1, greater than 99% of the surface area of ballast 40 is in close contact with case 20. Web 24 supports ballast rear end 46. Web 24 is an integral and continuous part of case 20. By wrapping part of the case around the back of ballast 40, large forces sustained by the ballast during impact are transferred back into the case, while minimizing stress concentrations which might cause the case to fail. Additionally, the outer surface of ballast 40 may be corrugated or crenulated with grooves, indentations, or protuberances 44. These wavy crenulations 44 mechanically interlock with the metal of case 20 during the manufacturing process and greatly increase the joint strength. Alternatively, metallurgical surface treatments, well known in the art, may be applied to the surface of ballast 40 to assure that it will join strongly with case 20 when the case 20 is formed around it. Also, diffusion barrier coatings may be applied to prevent the formation of undesirable intermetallic phases during manufacturing. Any of these methods, or all used in combination, helps to assure that the ballast shares forces and stresses that arise in the nose of the penetrator during penetration. The rear end 26 of penetrator 10 is securely closed with a solid metallic disk 29, which is fastened by screw threads, or other well-known means of mechanical attachment. FIG. 1 also shows a recessed bore 48 at the rear end 46 of ballast 40, and a hole 25 in web 24, both of which are left over from the manufacturing process (to be described). This cavity is filled by plug 87.

It should also be understood that while the cross-section of ballast 40 is illustrated in FIG. 1 as round and of relatively uniform diameter, the diameter may vary along the length of the ballast and any symmetrical cross-section may be utilized. Since the case is cast directly around the ballast, the case's metal will tightly interface with any surface profile of the ballast. The cross-section of case 20 may also vary along its length. Improved performance may be achieved by tapering the outer diameter of case 20 from a smaller diameter adjacent nose end 22 to a larger diameter at the base 26. The only requirement that may limit the shape of the resulting construction is that it be stable during penetration of the target.

Figure 2:
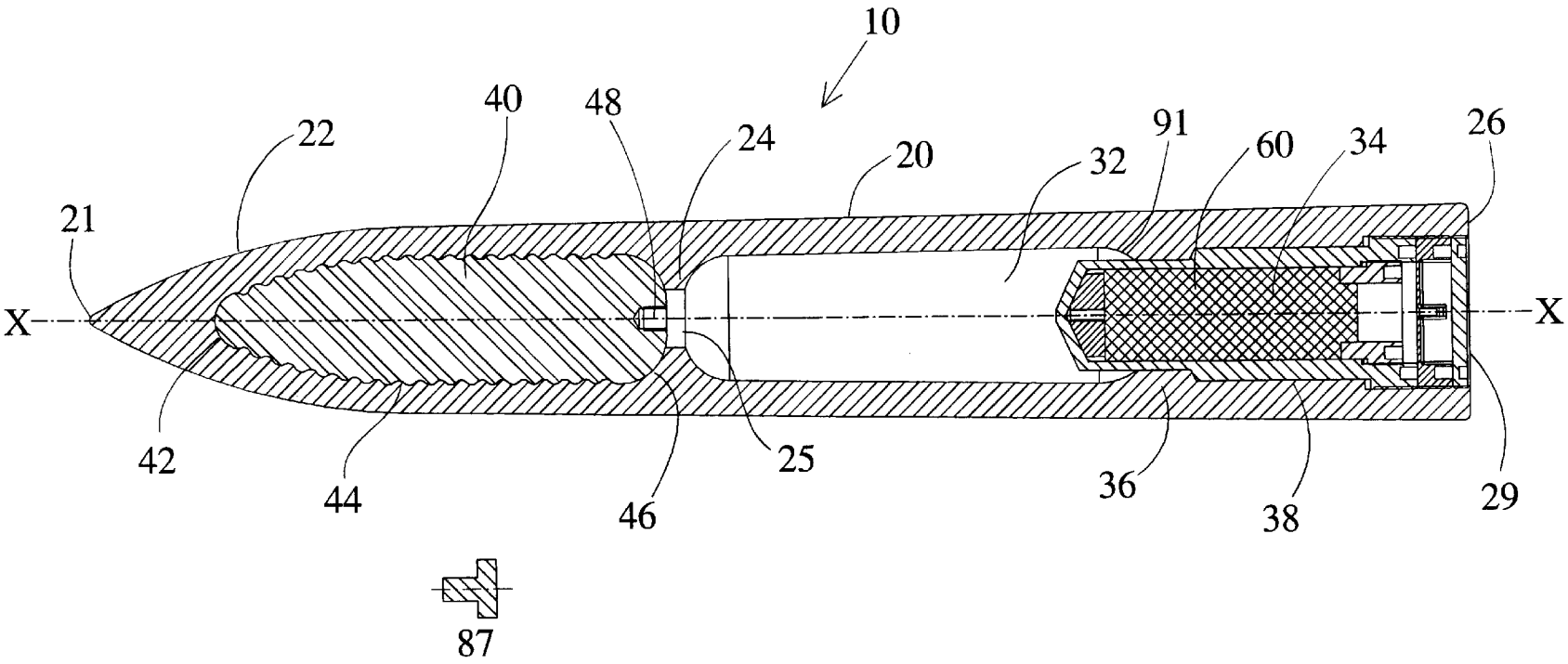
FIG. 2 shows a sectional view of a monolithic ballasted penetrator with a payload showing an instrument package.

As shown in FIG. 2, cavity 30 is illustrated as comprising two portions; a mid-case cavity 32 and a rear cavity 34 that extends through an opening in base 26. Rear cavity 34 may include at least one integral mounting pads, ribs, or rings 36 and 38, each comprising a short length of case 20 that has a thicker wall than the remainder of case 20. Reentrant angles 91 are visible on inward facing surfaces of the integral mounting ring 36. Such mounting features 36 and 38 serve two functions. First, they provide support for payload 60, which is sized to fit tightly in the smaller diameter of the instep portions. Secondly, they provide additional structural rigidity to the rear portion of case 20, to prevent excessive deformation of the case during impact. Payload 60 is fastened to the mounting features 36 and 38 by either screw threads, press fit, locking clamps, brazing, or other means for mechanical attachment well-known in the art. In FIG. 2, payload 60 is illustrated as an instrument package.

Figure 3:
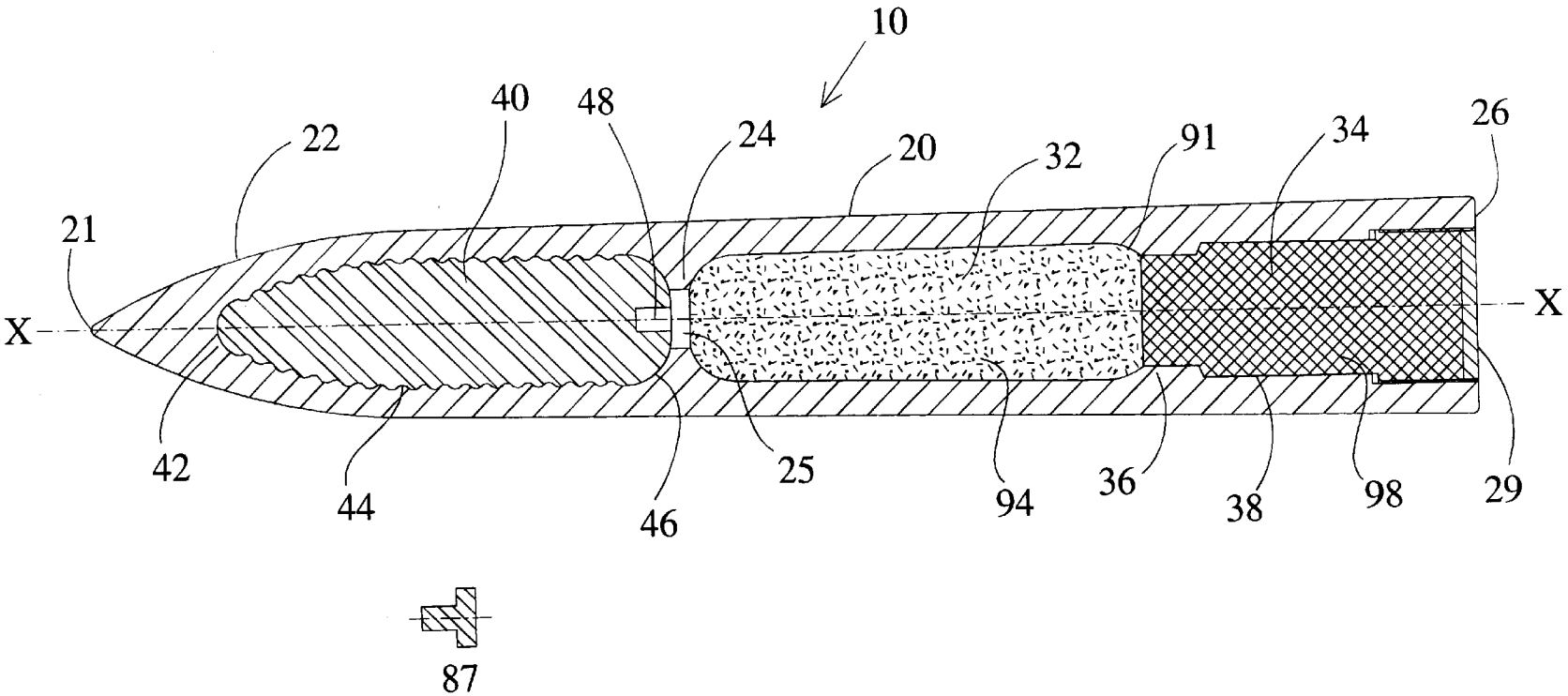
FIG. 3 shows a sectional view of a monolithic ballasted penetrator with a payload showing an explosive charge and an arming/fuzing device.

FIG. 3 shows the penetrator 10 in a weapons munitions application where mid-case cavity 32 contains an explosive or incendiary charge 94 and rear cavity 34 contains an arming and fuzing device 98. Because of the increased stiffness of the rear of case 20 provided by insteps 36 and/or 38, the payload will survive the passage of case 20 through a thick concrete target so that fuze 98 can detonate explosive 94 at the target.

Figure 4:
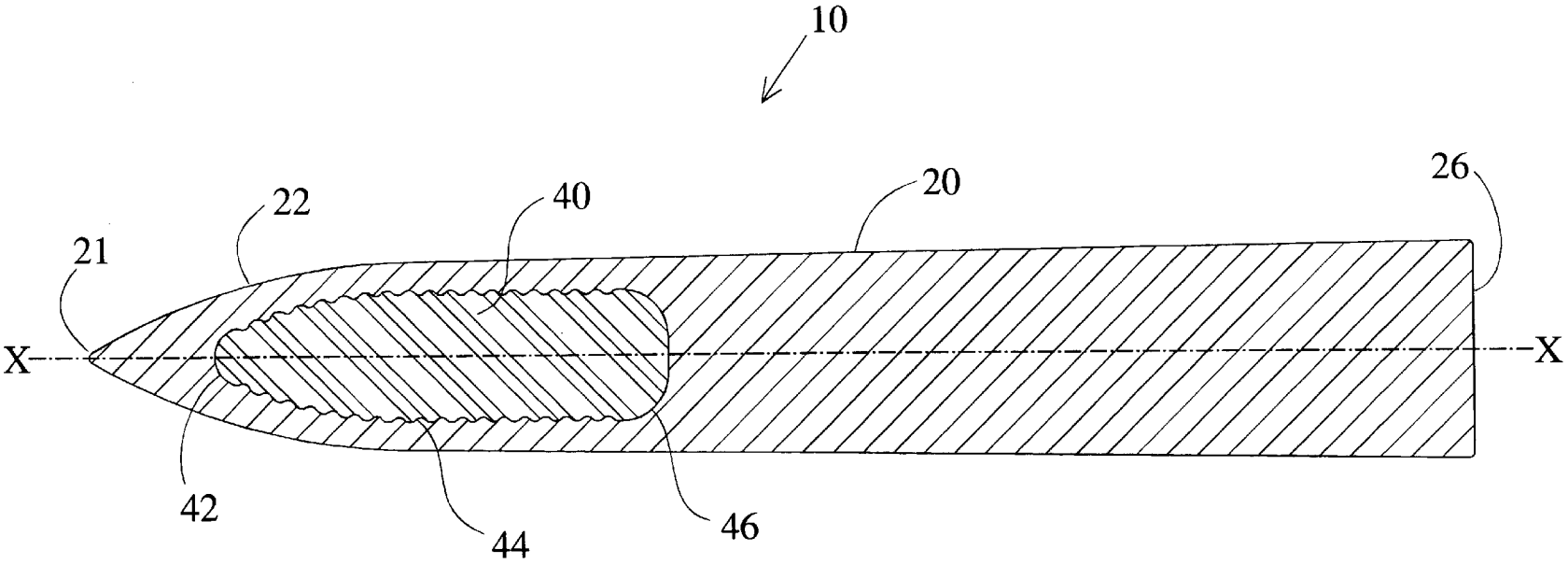
FIG. 4 shows a penetrator without a payload.

FIG. 4 shows a variation of the penetrator design without any cavity (e.g. no payload). Such a device could be employed to deeply penetrate solid rock in order to facilitate mining activities, such as deeply placing explosive charges.

Figure 5:
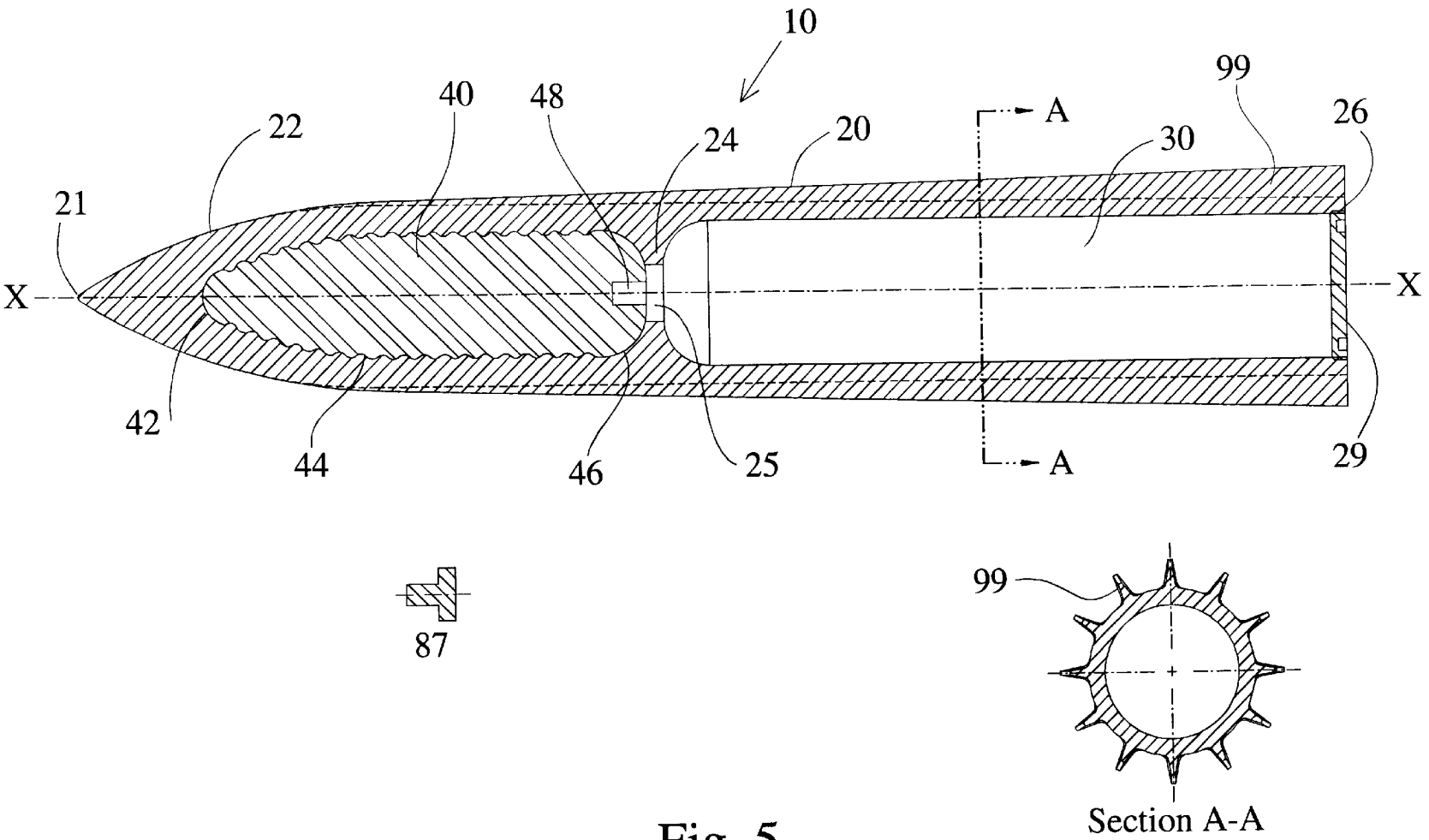
FIG. 5 shows a sectional view of a monolithic ballasted penetrator with integrally-cast external longitudinal stiffening ribs.
Figure 6:
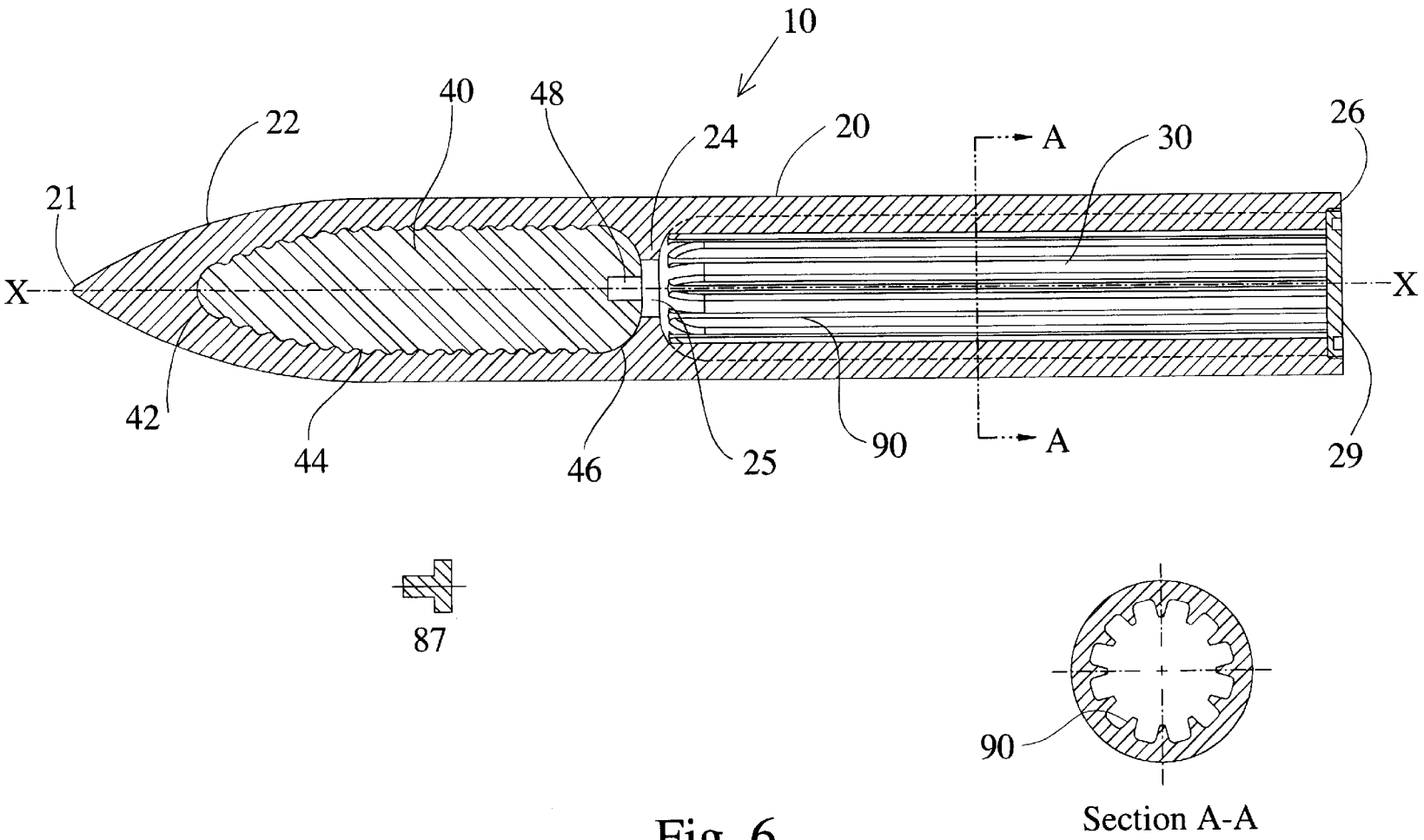
FIG. 6 shows a sectional view of a monolithic ballasted penetrator with integrally-cast internal longitudinal stiffening ribs.

If increased bending stiffness of the case is needed; integrally-cast external longitudinal stiffening ribs 99 (e.g. "strakes") could be added (see FIG. 5). Alternatively, the external strakes could be attached by other conventional means of mechanical attachment, such as brazing, riveting, etc. Use of strakes could also improve flight stability. In addition, integrally-cast internal longitudinal stiffening ribs 90 could be added to cavity 30 by having a series of longitudinal indentations spaced radially about core 84 (see FIG. 6). These internal ribs would also increase the bending stiffness.

Figure 7:
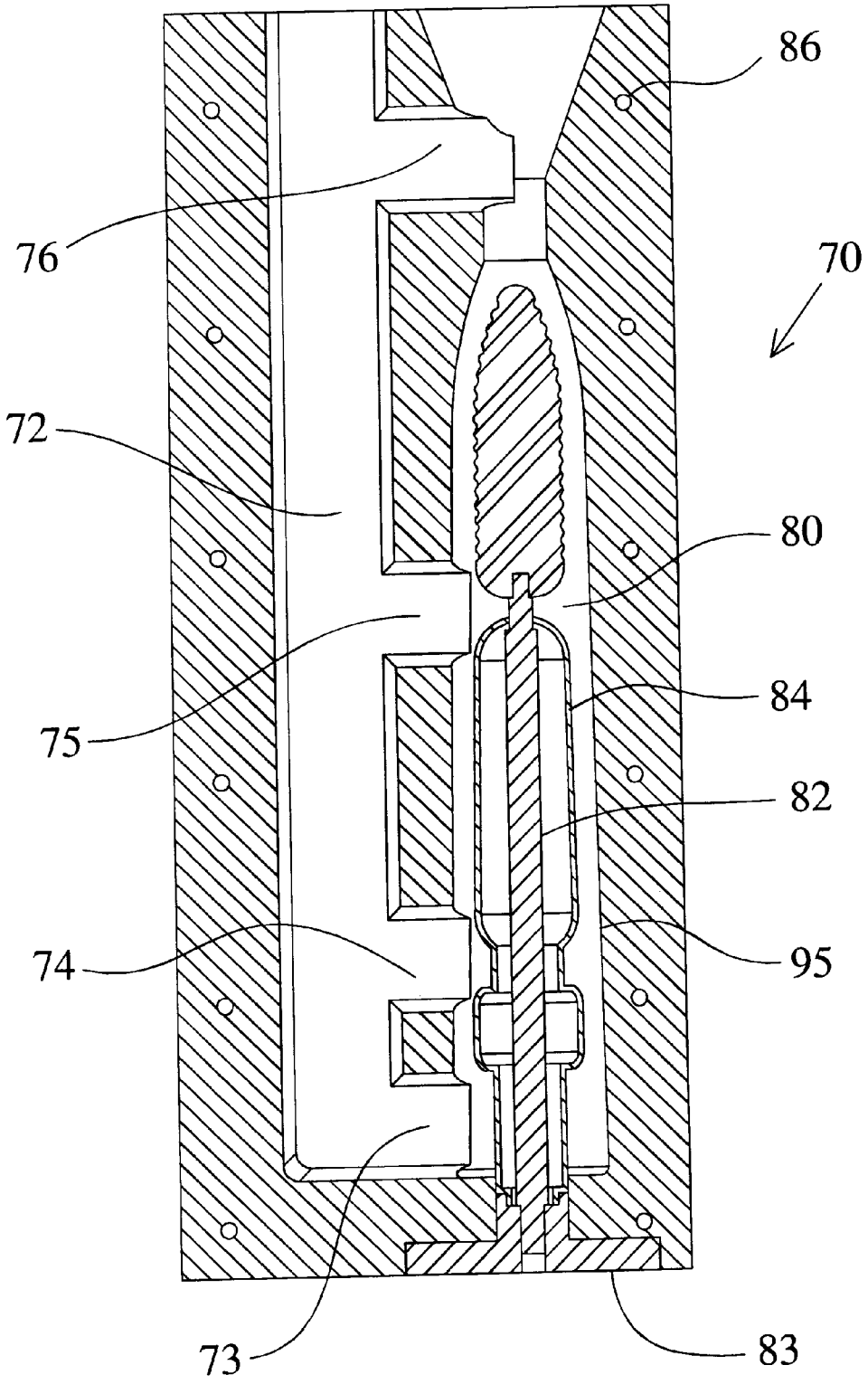
FIG. 7 shows a sectional view of a mold used to cast the penetrator's case around a ballast supported on a rod.

The preferred method of fabricating a monolithic ballasted penetrator includes casting the steel case 20 directly around the solid ballast 40. A preferable casting process uses both permanent mold casting and precision investment casting techniques. The outside contour of penetrator 10 is created by using a permanent, reusable, split steel mold 70, as illustrated in FIG. 7. Interior contours representing the inner surface of case 20 are created by a temporary core 84 that is later broken and removed after the casting has solidified. The two halves of the split mold 70 are machined from a steel billet and contain the necessary features, runners, and channels for distributing molten metal to the casting. All surfaces of the mold 70, or other metal parts, that are directly exposed to molten metal are lined with a ceramic material 95, well-known in the art, which prevents direct contact. The two halves of the split mold 70 are fastened together prior to casting, such as by bolting through holes 86.

The core 84 is made by the well-known investment method. A steel rod 82 supports the ballast 40 during the casting process. Mold 70 is arranged vertically and has a sprue 72 to receive molten steel. A plurality of runners 73–76 connect sprue 72 to cavity 80 in which penetrator 10 is made. Prior to application of the molten steel, ballast 40 is rigidly mounted inside cavity 80 on a steel support rod 82 that has a threaded portion which screws into a threaded bore 48 in ballast rear end 46. A core 84 surrounds rod 82 beneath ballast 40 and serves as a form for cavity 30 in penetrator 10. As is well known in the casting art, core 84 may be formed of ceramic, graphite, packed sand, or any other material capable of maintaining its form when subjected to the heat of molten steel and further capable of being broken up and removed or dissolved from penetrator 10 through base 26 after the steel has solidified. A support stand 83 fits into the bottom of mold 70, and rigidly supports the support rod 82.

The assembled mold 70, core 84, ballast 40, and support rod 82 are placed in a nose-up vertical orientation for casting. The steel alloy (not shown) for the case is melted in a vacuum environment and poured into mold sprue 72 and allowed to cool and solidify. Molten steel fills the space between the inner wall of cavity 80 and the outer surface of ballast 40 and core 84 from the bottom. After mold 70 has cooled, the two halves of the mold are opened and the solidified metal part, with its gates and runners still attached, is removed. The gates and runners are machined off from the solidified part, then steel rod 82 supporting ballast 40 is removed, and finally the core 84 is broken out or dissolved by an acid solution, well-known in the art. Then, the cast solid is densified by the common industrial operation of hot isostatic pressing. Annealing, if necessary, is done next. Then, the cast solid is machined to final dimensions on the outside, and any necessary internal features are added to cavity 30. Afterward, the finished penetrator 10 is given whatever final heat treatment is required to achieve maximum strength and toughness of steel alloy case 20. Finally, payload 60 is inserted and closing plate 29 is attached.

A preferred steel for the case is described in U.S. Pat. No. 5,087,415 of Hemhpill et al. and is sold as AerMet 100™ by Carpenter Technologies of Reading, Pa. This product is a tough, high-strength (280 KSI) nickel-cobalt steel strengthened by additions of carbon, chrome, and molybdenum that was developed for use in naval aircraft landing gear. The process of casting and hot isostatic pressing this alloy is described by Novotny et al., "Navy Fighter Demands Evolve into Tough Castings", *Foundry Management and Technology,* December 1993, pp. 33–36, which article is incorporated herein by reference.

Desirable properties for the ballast include a minimum yield strength of about 80 KSI and good ductility. Lead, a traditional ballast material, is not acceptable because of its low strength. Since the ballast is also a load-carrying structural member, use of a strong ballast material allows the steel case wall thickness to be minimized in the nose. This allows the space to be used more efficiently than if the penetrator was simply carrying soft lead as a "payload", rather than as a structural element. A preferred alloy for the dense ballast is a tungsten alloy, W—Ni—Fe (94% W with a binder comprising 80% Ni & 20% Fe). Other tungsten alloys compositions within the W—Ni—Fe family are acceptable. This family of W—Ni—Fe alloys is made by a liquid metal sintering process, then machined using conventional machining steps. Other heavy materials, which could be used for the ballast, are discussed earlier in the Specification.

The various runner and gate sizes for mold 70, and the rates of filling, heating, and cooling the molten metal, are calculated using commercially available software in a manner well-known in the casting art.

As illustrated in FIG. 1, removal of rod 82 after casting leaves an open bore 48 in ballast 40 and hole 25 in web 24. Both bore 48 and hole 25 may be plugged by inserting an appropriately machined plug 87 into bore 48 and hole 25 prior to insertion of payload 60. Because the mass of plug 87 is very small, it does not pose a risk to the payload because of possible movement under acceleration.

Since cavity 30 is formed by the molten steel flowing around core 84 and hardening, it should be understood that cavity 30 may take almost any symmetric form, so long as the combination of cavity and payload are stable in flight.

Figure 8:
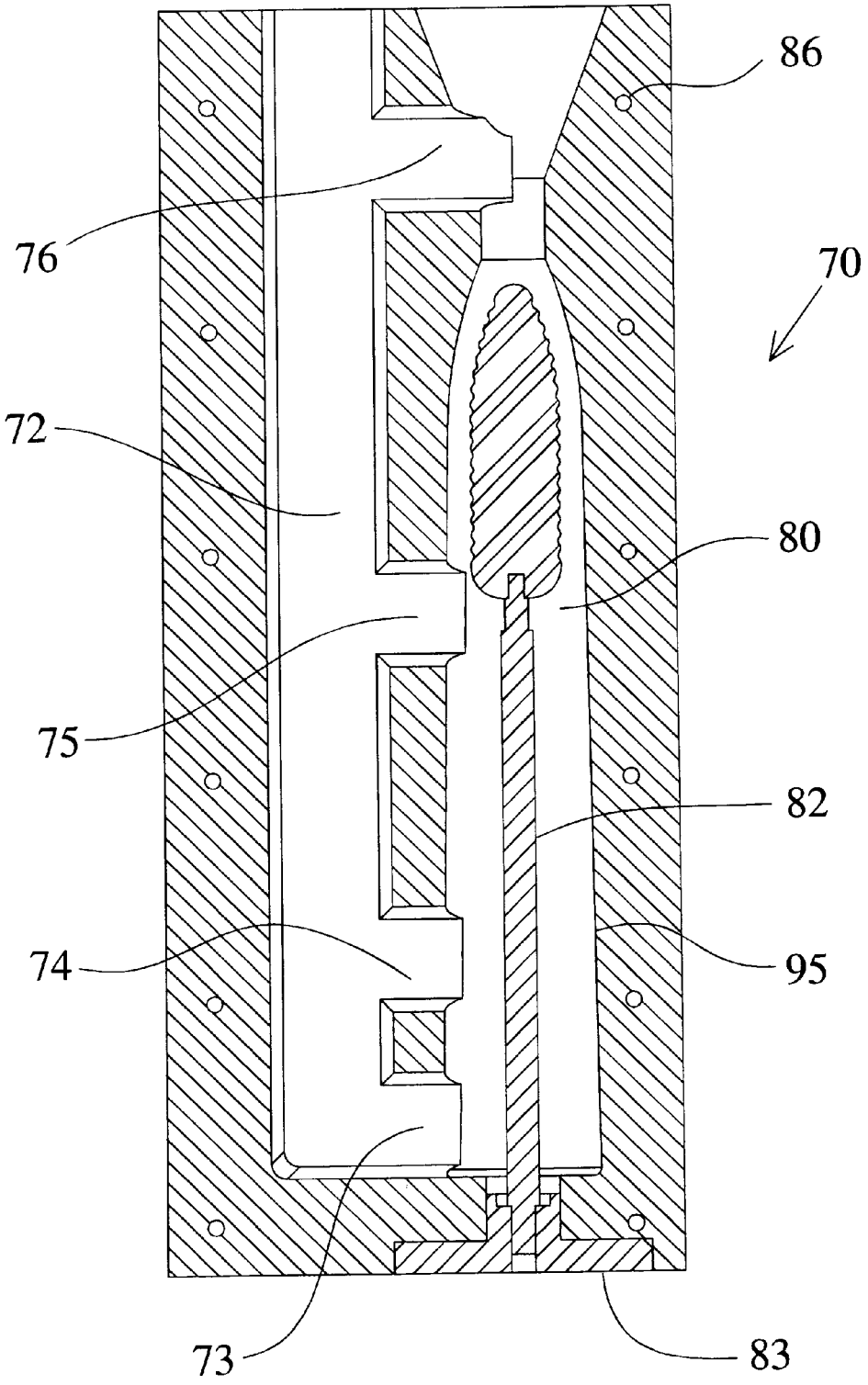
FIG. 8 shows a sectional view of a mold used to cast the penetrator's case around a ballast supported on a rod; the penetrator does not have a payload.

FIG. 8 shows a sectional view of a mold used to cast the penetrator's case around a supported ballast, without a payload. In this figure, the core piece 84 is not used because there is no interior cavity space in this embodiment of the penetrator.

The particular sizes and equipment discussed above are cited merely to illustrate a particular embodiment of this invention. It is contemplated that the use of the invention may involve components having different sizes and shapes as long as the principle of enclosing a ballast within a case is followed. For example, the ballast may be of any flight-stable shape and cross-section. The ballast could also be divided and molded into separate portions of the case.

Figure 9:
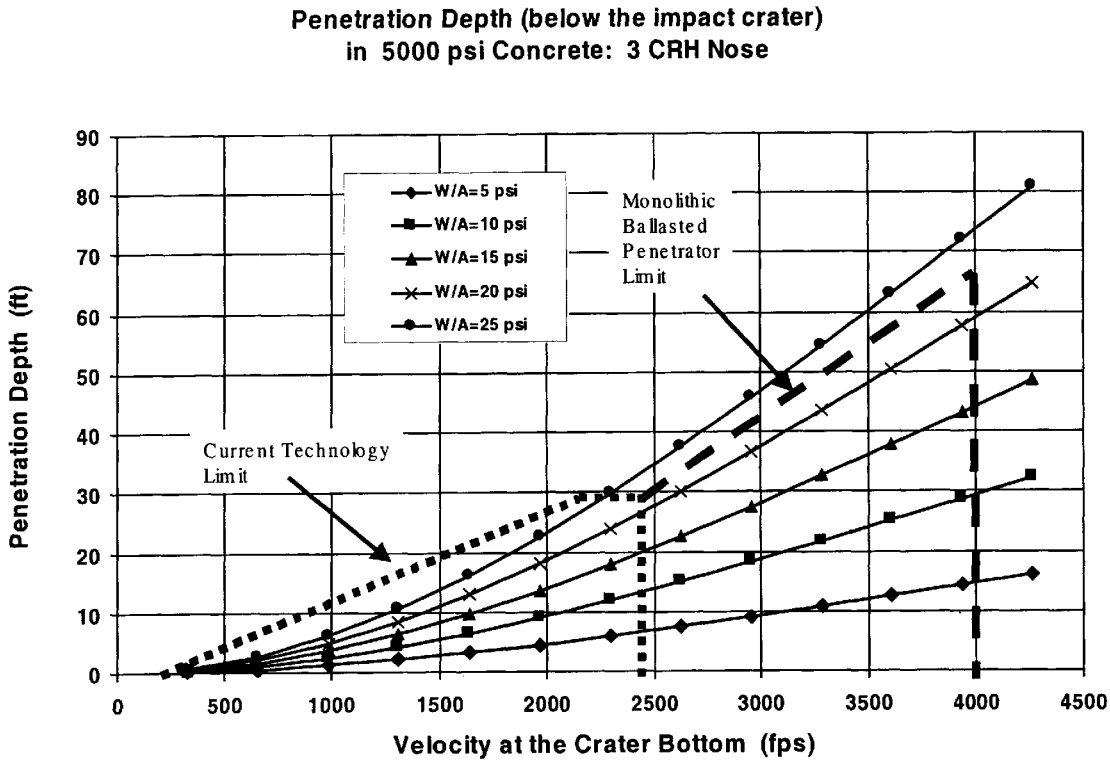
FIG. 9 shows the calculated depth of penetration as a function of velocity for the monolithic ballasted penetrator.

FIG. 9 shows the calculated penetration depth for the penetrator of this invention. As the several curves in the graph show, penetration depth in 5000 psi concrete increases as a function of velocity at impact and W/A, where W is the weight and A is the average cross-sectional area of the penetrator. The area within the dotted-line box indicates the penetrators sized to be carried by a missile. A 10 inch diameter penetrator with a weight of about 1200 lbs. has a W/A=15 and is expected to penetrate 35 feet of concrete upon impact at 3500 feet/sec.

Two models of the penetrator having slightly tapered bodies have been successfully constructed. Each is about 30 inches long and has a nose-end diameter of 4 inches and an aft end diameter of 4.67 inches. Each model weighed about 95 lb. before the installation of a payload of ancilliary test devices. One prototype penetrator was gun-launched at 3050 ft/s into a concrete target, penetrating 12 ft before coming to rest. Without the heavy material ballast the penetrator would have been expected to penetrate less than 9 ft. Post-test examination revealed that the method of holding the ballast functioned as designed and that the ballast stayed in place during the event.

The dimensions of the penetrator described in this Specification are not intended to limit the present invention to only large penetrators. Rather, any size of bullet or ammunition could be fabricated as described by the present invention, subject to the practical limitations of the fabrication techniques. The present invention would function extremely well as an armor-piercing bullet intended to be fired from a firearm, for example. Also, while the preferred embodiment of the present invention is intended to be gun launched as a full-caliber projectile, other embodiments of the penetrator could comprise sub-caliber sizes, used in combination with a sabot-type holder.

What is claimed is:

1. A monolithic ballasted kinetic energy penetrator comprising:

a monolithic case made of a first material, said case having a case axis aligned with the direction of penetrating motion; and five continguous regions comprising:

a nose end having a generally ogival outer shape;

a pointed tip of said nose end;

a continuous outer surface extending from said pointed tip to;

a middle section having a continuous, unjointed surface comprising an elongated, generally cylindrical or conical shape extending along said case axis; extending to a base having a flat end;

a ballast made of a second solid material whose density is substantially greater than said first material;

said ballast being disposed within said monolithic case;

said ballast having a rear end facing the base of said case; and said ballast having an outer surface area substantially surrounded by, and joined to, said monolithic case; and an integral web extending across said middle section and supporting the rear end of said ballast; said web having a rear side facing the base of said case; whereby said ballast is constrained in all directions against movement relative to said monolithic case.

2. The penetrator of claim 1, wherein said ballast has:

a ballast axis aligned with the direction of penetrating motion;

an elongated, generally cylindrical shape extending along said ballast axis;

a location disposed far forward inside the penetrator, substantially towards the tip of said nose end; and a forward end that faces the tip of said nose end;

a shape of said forward end that closely matches the generally ogival outer shape of said nose end.

3. The penetrator of claim 1, wherein the orientation of said case axis is substantially coincident with said ballast axis.

4. The penetrator of claim 1 wherein portions of the outer surface of said ballast are crenulated, said first material conforming to said crenulated portions.

5. The penetrator of claim 1 wherein the outer surface of said monolithic case tapers from a smaller diameter adjacent said nose end, to a larger diameter at said base.

6. The penetrator of claim 1 additionally comprising a plurality of external longitudinal stiffening ribs disposed around the outer surface of said monolithic case.

7. The penetrator of claim 1 wherein said first material, used for said monolithic case, is a high-strength steel alloy.

8. The penetrator of claim 7 wherein said high-strength steel alloy, used for said monolithic case, is a high-strength nickel-cobalt steel alloy strengthened by additions of carbon, chrome, and molybdenum.

9. The penetrator of claim 1 wherein said second solid material has a density greater than about 13 g/cm$^3$.

10. The penetrator of claim 9 wherein said second solid material is selected from the group consisting of tungsten, tantalum, tungsten alloys (W—Fe—Ni, W—Re, W—Hf—Re, W—LaO2, W—ThO2) single crystal tungsten, tungsten carbide, cemented tungsten carbide (tungsten carbide-cobalt), depleted uranium and it's alloys.

11. The penetrator of claim 1, additionally comprising at least one metallurgical coating placed on the outer surface of said ballast for improving the quality of joining between said ballast and said monolithic case.

12. The penetrator of claim 1, wherein said case includes a rearwardly open hollow cavity disposed within said monolithic case, having a front end defined by the rear side of said integral web; and a flat, open rear end defined by the base of said monolithic case.

13. The penetrator of claim 12, additionally comprising:

a payload disposed within said rearwardly open hollow cavity;

means for fastening said payload within said rearwardly open hollow cavity; and means for securely closing the flat, open rear end of said rearwardly open hollow cavity.

14. The penetrator of claim 13, wherein said payload comprises an energetic material and a fuze for said energetic material, said fuze being located near the base of said monolithic penetrator and securely fastened to said monolithic case; and said energetic material being located in between said integral web and said fuze.

15. The penetrator of claim 13 wherein said payload comprises an instrumentation package securely fastened to said monolithic case.

16. The penetrator of claim 12 wherein said rearwardly open hollow cavity additionally comprises a plurality of longitudinal stiffening ribs made integral with said monolithic case.

17. The penetrator of claim 13, wherein said rearwardly open hollow cavity additionally comprises:

a plurality of integral interior mounting features, made continuously of said first material, wherein the shape of said mounting features is selected from the group consisting of pads and rings; and said payload is securely fastened to said integral mounting features.

18. The penetrator of claim 17 wherein said integral mounting features additionally comprise reentrant angles.

19. The penetrator of claim 16 wherein said integral longitudinal stiffening ribs additionally comprise reentrant angles.

20. A method of making a monolithic ballasted kinetic energy penetrator by casting comprising the steps of:

placing a ballast formed of a first material in a mold, said ballast having an outer surface;

filling said mold with a molten second material, said second molten material surrounding substantially the entire outer surface of said ballast;

cooling said second material until it hardens; and removing said mold.

21. The method of claim 20 wherein said penetrator has a nose end and a base connected by a continuous side, the ballast being adjacent the nose end, the method further comprising:

placing a core into the mold, said core having a solid outer surface adjacent the base, said core having a melting temperature that is higher than the second molten material, a portion of said core extending through the base, filling the entire outer surface of said core with molten metal, except for the portion extending through the tail end of the penetrator;

removing the mold; and removing said core.

22. The method of claim 21 wherein the core is ceramic and is broken into small pieces for removal.

23. The method of claim 21 further comprising the step of applying metallurgical coatings to the surface of said ballast to improve joining with said second material.

24. The method of claim 21 further comprising the step of hot isostatic pressing after said casting step.

25. The method of claim 21 further comprising the step of performing heat treatment after said casting step to strengthen said second material.

26. The method of claim 21 wherein said mold further comprises a two-piece, split steel reusable mold, coated with a ceramic material to prevent direct contact of said molten second material with the inner surfaces of said steel mold.

27. The method of claim 20 wherein said method for placing a ballast in a mold further comprises supporting said ballast on the end of a support rod.

28. A penetrator made by the process of claim 20.

29. A monolithic ballasted kinetic energy penetrator comprising:

a monolithic case made of a first material, said case comprising:

a nose end having a generally ogival outer shape with a pointed tip; and a continuous, unjointed outer surface;

a ballast, disposed within the case near the nose end; and made of a second material whose density is substantially greater than the density of the first material; wherein the ballast has an outer surface that is completely surrounded by, and is joined to, the case; whereby the ballast is constrained in all directions against movement relative to said monolithic case.

* * * * *